United States Patent [19]

Grigar

[11] Patent Number: 4,664,184

[45] Date of Patent: May 12, 1987

[54] BALANCED ISOLATION TOOL ENABLING CLEAN FLUID IN TUBING PERFORATED OPERATIONS

[75] Inventor: Larry L. Grigar, East Bernard, Tex.

[73] Assignee: Halliburton Company, Duncan, Okla.

[21] Appl. No.: 846,548

[22] Filed: Mar. 31, 1986

[51] Int. Cl.[4] ..... E21B 43/116

[52] U.S. Cl. ..... 166/55.1; 175/4.56

[58] Field of Search ..... 175/4.52, 4.54, 4.56; 166/297, 55.1

[56] References Cited

U.S. PATENT DOCUMENTS

| | | | |
|---|---|---|---|
| 2,760,408 | 8/1956 | Taylor | 166/55 |
| 4,498,541 | 2/1985 | Brieger et al. | 175/4.52 |
| 4,541,486 | 9/1985 | Wetzel et al. | 175/4.52 |
| 4,557,331 | 12/1985 | Stout | 166/297 |

*Primary Examiner*—Stephen J. Novosad
*Assistant Examiner*—Hoang C. Dang
*Attorney, Agent, or Firm*—William J. Beard

[57] ABSTRACT

In tubing conveyed perforating well completion operations, shaped charge detonation is achieved by dropping a detonating bar in the tubing string. Velocity of the detonating bar is controlled by placing a column of standing fluid above the tubing conveyed perforating assembly. This apparatus and method isolate a column of standing fluid. Moreover, invasion by a well fluid is prevented to assure that the retardation characteristics of the standing fluid are not changed by invading well fluids. The apparatus includes a tubing string pressure isolation piston assembly slidable within a sleeve and a frangible closure disk broken by the detonating bar; the isolation tool further includes check valve means controllably venting fluid pressure across the valve means.

8 Claims, 2 Drawing Figures

BALANCED ISOLATION TOOL ENABLING CLEAN FLUID IN TUBING PERFORATED OPERATIONS

BACKGROUND OF THE DISCLOSURE

In completion of a well, one process presently in favor is the use of a tubing conveyed perforating assembly suspended on a tubing string to form perforations at a specified depth in the well. The TCP process typically involves suspending a set of perforating guns (ranging from a few to several hundred) at the lower end of the tubing string. The tubing string is assembled at the well head and lowered into the well. The TCP assembly is guided by a packer to register the TCP assembly opposite the formation of interest prior to forming the perforations. Ordinarily, a detonating bar is dropped free fall in the tubing string. The bar strikes the top end of the apparatus with the TCP assembly thereby triggering detonation. The detonating bar normally weighs quite a bit. Moreover, the tubing string can be quite long, easily more than 10,000 feet, and the bar may well reach significant velocity as it falls into the well. If the bar falls freely without impediment, it will travel with sufficient kinetic energy that it may do damage to the equipment at the top end of the TCP assembly. Because of this, it is desirable to retard the rate of fall of the detonating bar. One way to do this is to place a standing column of liquid above the TCP assembly so that the detonating bar is retarded by the liquid. This regulates detonating bar velocity to assure that the kinetic energy in the impact is in an acceptable range.

One problem which makes detonating bar velocity variable is a change in viscosity of the fluid in the tubing string. Assume as an easy example that the tubing string is filled with certain depth with clean water. This will provide a known retardation to the velocity of the drop bar. On the other hand, if the water mixes with drilling fluids or formation fluids or both, it can easily become quite different in physical characteristics and thereby provide significantly different retardation to the velocity of the detonating bar. It is therefore desirable to limit commingling of the fluids so that drilling fluids or formation fluids on the exterior of the tubing string do not invade the string and thereby change the viscosity of the standing column of liquid. It is particularly possible to mix drilling fluid in the water and thereby significantly change the retardation of the water to the dropped detonating bar.

The present apparatus enables isolation of the standing column of water above the TCP assembly. Moreover, there maybe variations in downhole pressure. The present apparatus accommodates pressure differentials between the column of standing fluid above the TCP assembly and the exterior in the annulus of the well. Briefly, this apparatus includes a floating piston assembly which is enclosed in a suitable sub. The piston assembly can ride up and down to achieve a pressure balance. The floating piston assembly is sealed over by glass disk. When the detonating bar is dropped, it shatters the glass disk and passes through it. The sacrificial glass disk isolates fluid therebelow to assure that that fluid is clean. Thus, the floating piston assembly rises and falls for clean fluid isolation. Moreover, should pressure increase below the glass disk, an O-ring valve assembly vents fluid in one direction only, thereby accomplishing controllable pressure relief, all as will be set forth in detail herein after.

DETAILED DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

Figure 1:
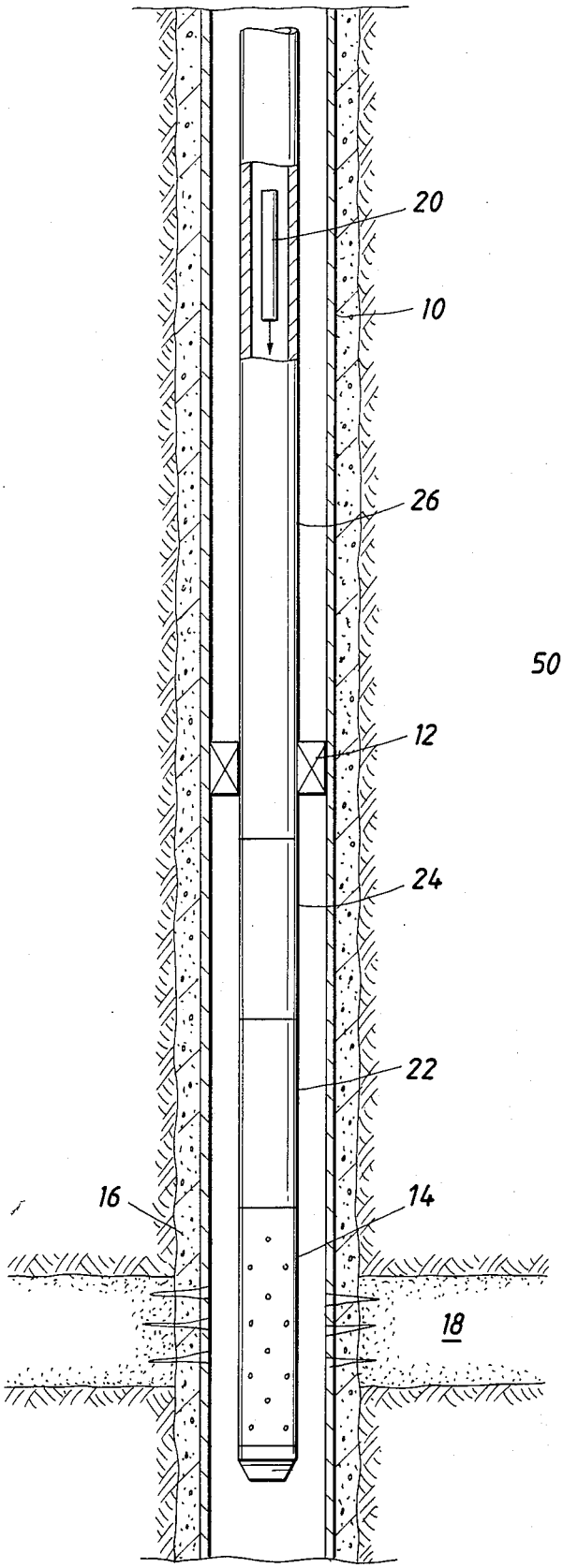
Figure 2:
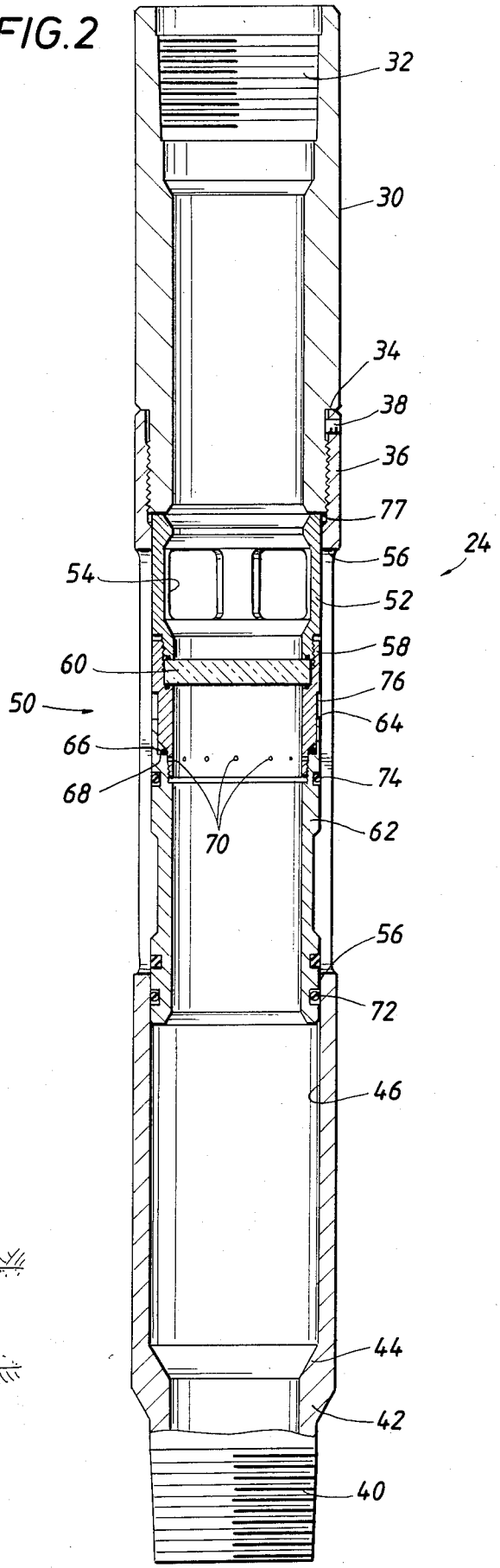

FIG. 1 shows a tubing conveyed perforating assembly on a tubing string suspended in a well wherein the isolation tool of the present disclosure is installed in the tubing string to protect a standing column of clean fluid in the tubing string; and FIG. 2 is a detailed sectional view through the isolation tool of the present disclosure.

DETAILED DESCRIPTION OF THE PREFERRED EMBODIMENT

Attention is first directed to FIG. 1 of the drawings. There, a well has been shown where production steps are being undertaken including the detonation of shaped charges to form perforations. The well is cased at 10 and a packer or other landing nipple is located at 12 to support a TCP assembly 14. The assembly 14 is of any suitable length, and includes detonating apparatus as well as a specified number of shaped charges. They point radially outwardly at selected spacing and angular positions to perforate the casing 10. They will also perforate through the surrounding cement 16 which anchors the casing in location. The perforations are formed into adjacent formations including a sand of interest indicated at 18. It is intended that production be obtained from the sand, and to this end, the TCP assembly 14 is positioned so that the perforations are formed at the proper depth in a required number. The TCP assembly 14 is thus placed in registry with a packer or other landing device which assures that the perforations are formed at the proper depth.

The TCP assembly supports an internally located detonator mechanism (at the upper end) which is actuated by a dropped detonating bar. The numeral 20 represents such a detonating bar traveling free fall in the tubing string. The tubing string is assembled above the TCP assembly 14 by placing a first tubing section 22 thereabove. It has a desired length. The isolation tool of the present disclosure is located thereabove at 24 in the tubing string. Additional joints of tubing are added at 26 to obtain the necessary length such that the TCP assembly is located at the proper depth. The tubing 26 can be several thousand feet in length. By contrast, the tubing 22 (above the TCP assembly and below the isolation tool) is a desired length and is filled with a clean fluid. As a representative example, it might be 60 feet from the top of the TCP assembly at 14 to the isolation tool 24 of the present disclosure. The requisite tubing joints are placed below the isolation means 24 and are filled with clean fluid to obtain a standing column of fluid retarding the velocity of the dropped detonating bar to a desired velocity. The fluid is clean and is also isolated, thereby assuring that invading well fluids do not change the viscosity or makeup of the standing column of fluids. In a typical situation, the tubing will range from about 2⅞ inches in diameter and up. The present apparatus is installed in the tubing string at a desired location above the TCP assembly 14. Connections are made with conventional threaded pin and box connections well known for tubing strings.

Going now to the detailed view of the isolation tool 24 better shown in FIG. 2, its construction will be described from the top to the bottom. The numeral 30 identifies an upper end sub which has a mating threaded box 32 for makeup in the tubing string. The sub 30 has a specified length and terminates at a shoulder 34. Moreover, it threads to a sleeve 36 which is fixedly attached by means of a suitable set screw 38. The components not only thread together as illustrated, but they are also held against unthreading by positioning the set screw at the illustrated location. The sleeve 36 is of any suitable length and terminates at a pin connection 40 at the lower end to enable continuation of the tubing string. The pin connection is immediately adjacent to an enlarged or thickened wall portion 42 which defines a shoulder 44. This shoulder limits travel of components in the isolation tool which will be described.

The numeral 46 identifies the cylindrical interior wall of the sleeve. This serves as a guide and seal surface for a traveling assembly. This assembly is generally described as a floating piston assembly at 50. This assembly is formed by several components which move together. One of the components is a sleeve 52. It is axially hollow and is formed with a fluid drainage port at 54. Any fluid introduced into the tubing string thereabove will drain to the exterior through the port 54. The sleeve 52 is captured on the interior of the sleeve 36. The sleeve 36 has several long slots formed at 56. The sleeve 52 is threaded to a valve sleeve 58. The two components thread together capturing a frangible glass disk 60. The disk 60 is sized so that it is easily broken by the falling detonating bar 20. The disk 60 is sufficiently thick that is supports a standing of a column of fluid thereabove that in the event that fluid accumulates in the tubing string above the isolation tool 24. Leakage past the disk is prevented by securing the disk with suitable O-ring seals in facing grooves as illustrated in FIG. 2.

The valve sleeve 58 threads to another sleeve at 62. The sleeve 62 extends the length of the floating piston assembly, and cooperates with the valve sleeve 58 in a special fashion as will be described. The valve sleeve 58 terminates at a shoulder 64. The shoulder 75 supports on O-ring 66 riding on the shoulder. The O-ring is captured by its own resiliency and tends to shrink against the shoulder 75. It is confined by the abutting shoulder, thus fitting in a V-shaped groove. A fluid flow path is defined through ports or openings 70 below the O-ring 66, thereby forcing the O-ring 66 to expand. Fluid flows past the O-ring and along the shoulder 75 to escape through lots 76 from between the components 58 and 62. This fluid is then on the exterior of the floating piston assembly 50. It is voided through the slots 56 as shown in FIG. 2.

The piston assembly 50 travels upwardly and downwardly. It is guided by the elongate construction shown in FIG. 2. Suitable O-rings 72 and 74 prevent leakage below the piston assembly 50. The floating piston assembly 50 thus defines two flow paths from the interior of the balanced isolation assembly to the exterior. The large port 54 is located above the glass disk at 60. Any fluid which is in the tubing string above the isolation tool 24 drains to the port 54 and out through the slots 56. A second drainage path is included for the tubing string below the glass disk. This flow path is controlled by a check valve mechanism. The flow path includes the several holes 70. The check valve mechanism includes the O-ring 66 on the tapered surface 75. The flow path is from the interior to the exterior under control of the check valve. Flow in the opposite direction is not permitted by operation of the check valve O-ring 66.

Operation of this isolation tool 24 should be considered. Assume that it is installed in the tubing string and located in the well. Assume further that a measured standing column of clean fluid is located therebelow. The standing column of clean fluid is protected by this apparatus. Assume further that there is fluid in the tubing string above the isolation tool 24. In that instance, when the detonating bar 20 is dropped, it simply travels along the tubing string and ultimately arrives at the fluid above the isolation tool 24. The fluid above the isolation tool 24 will slow the bar 20 to cushion impact on the isolation tool 24. The detonating bar will strike and break the glass disk 60. Then, it falls through the standing column of clean fluid, having the desired retardation.

Consider the column of liquid above the disk 60. Assume that the fluid is quite different from the isolated clean fluid below the isolation tool. Excess fluid above the isolation tool is free to drain out through the port 54 assuming there is a pressure differential acting across the port 54. Whether some fluid drains or not, the dropped detonating bar will fall along the tubing string through fluid above to tool 24, strike the disk 60 and then fall in the column of clean fluid. Even when the bar 20 falls through heavy or viscous drilling fluid above the glass disk 60, the velocity of the dropped detonating bar is still sufficient to break the disk 60 and then fall at a desired velocity in the clean fluid such that the TCP assembly therebelow is properly operated.

The isolation tool 24 isolates two separate columns of fluid. The fluid below the isolation tool 24 is clean to obtain controlled bar velocity, and also has a fixed length to assure a desired terminal velocity. The isolation tool 24 separates the upper fluid column thereabove. The upper fluid column is included to slow down the bar 20 to limit impact damage at the tool 24. To illustrate, assume that the packer is located at a depth of 10,000 feet. Assume further that the isolation tool 24 is at 10,050 feet. Assume further that 60 feet of clean water is isolated between the tool 24 and the TCP detonating apparatus. If the bar 20 is dropped in open tubing, the velocity may well be in excess of 100 miles per hour at the impact with the glass disk; such a high velocity impact will destroy the disk and may well damage the bar 20. Therefore a column of standing fluid is placed above the disk to slow the projectile bar. As an example, the velocity can be slowed by 50 feet of relatively thick mud.

The dropped detonating bar 20 will impact the first fluid column (above the tool 24) and be slowed to some speed; in fact, any speed sufficient to break the glass disk will suffice. The velocity is retarded to limit impact damage. Then the bar 20 falls through the controlled viscosity fluid at a velocity regulated by the isolated column of fluid. This rate of fall is controlled or limited to a desired range. By contrast, the column of fluid above the isolation tool 24 can vary over a wide range in viscosity and fluid column height. Even though the upper column of fluid may vary widely, the isolated column does not vary (by virtue of its isolation) so much and hence the bar 20 velocity is regulated. This limits impact damage and yet assures adequate impact and detonation.

As a further possibility, the pressure on the outside of the tubing string may increase. The floating piston assembly is free to travel downwardly through a specified stroke, the stroke being determined by the spacing between the downwardly facing shoulder 77 and the upwardly facing shoulder 44 near the bottom of the isolation tool 24. The glass disk 60 is sufficiently thick to withstand some pressure differentials acting thereacross.

Assume however, that the pressure differential acting on the floating piston assembly 50 forces it upwardly. It is free to travel upwardly, but travel is limited by the shoulder 34. Pressure relief from below the floating piston assembly is obtained by the valve means incorporating the O-ring 66. This function as a check valve. When a suitable pressure differential acts across the device, fluid flows past the O-ring 66. The escape path for the fluid extends to the slots 56 formed in the surrounding sleeve. Because of this arrangement, the piston assembly 50 can travel downwardly to equalize pressure. Additionally, it can travel upwardly to equalize pressure. If travel upward to the shoulder at 34 limits further movement, the O-ring 66 functions as a check valve thereby venting pressure fluid to obtain pressure equalization.

In a typical installation, the travel of the traveling piston assembly is quite small compared to the height of the column of standing clean fluid therebelow. Thus, when the detonating bar is dropped, it can be known with certainty that the detonating bar velocity through the standing column of fluid is regulated. This assures proper operation of the detonating bar, particularly controlling the velocity and impact of the detonating bar on the TCP assembly. Moreover, the clean fluid is protected because it is isolated to avoid invasion by well fluids which might change of the nature of the column of fluid.

While the foregoing is directed to the preferred embodiment, the scope is determined by the claims which follow.

What is claimed is:

1. Fluid isolation apparatus for installation with a tubing conveyed perforating gun assembly supported on a tubing string, the apparatus comprising:

(a) tubular means having threaded ends and adapted to be threaded into a tubing string at a desired distance above a tubing conveyed perforating gun assembly and further being adapted to isolate a standing column of fluid above the tubing conveyed perforating gun assembly and below said tubular means;

(b) closure means extending across said tubular means for isolating fluid therebelow from invasion from the exterior;

(c) said closure means being adapted to permit passage of a dropped detonating bar to trigger operation of the tubing conveyed perforating gun assembly; and (d) valve means operable in a single direction only and having a fluid flow path opening from the tubing string below said tubular means to an exterior point, said valve means comprising a resilient O-ring on a tapered surface, said O-ring and tapered surface permitting fluid flow by radially expanding said O-ring and forbidding fluid flow in the opposite direction.

2. The apparatus of claim 1 wherein said closure means is supported by a floating sleeve slidably received for telescoping movement upwardly or downwardly in said tubular means.

3. The apparatus of claim 1 wherein said valve means includes V-shaped surface with said O-ring positioned in the V of said V-shaped surface, and further including passage means extending from an opening on the interior of the tubing string below said closure means to said V-shaped surface.

4. The apparatus of claim 1 wherein said closure means comprises:

(a) a transversely positioned closure disk of material breakable by the detonating bar;

(b) sliding mounting means supporting said disk for movement along said tubular means; and (c) seal means sealing said disk to prevent leakage of fluid from above said tubular means past said disk.

5. The apparatus of claim 4 wherein said mounting means includes:

(a) a sleeve slidably received in said tubular means; and (b) spaced, facing shoulders in said tubular means limiting travel of said sleeve.

6. The apparatus of claim 5 including a port in said sleeve above said disk for draining fluid away from said disk.

7. The apparatus of claim 6 including opening means through said tubular means aligning with said port to define a fluid drainage path.

8. The apparatus of claim 7 wherein said opening means is a set of parallel slots along said tubular means.

* * * * *